United States Patent [19]

Brinton, Sr.

[11] 4,414,770

[45] Nov. 15, 1983

[54] MAXI-BALL LUBRICATOR

[76] Inventor: Charles E. Brinton, Sr., 1110 Penn St., Harrisburg, Pa. 17102

[21] Appl. No.: 331,669

[22] Filed: Apr. 5, 1982

[51] Int. Cl.[3] ..... F41C 27/00

[52] U.S. Cl. ..... 42/90

[58] Field of Search ..... 42/90; 86/19, 33

[56] References Cited

U.S. PATENT DOCUMENTS 4,152,858 5/1979 Dobbs ..... 86/33

4,254,572 3/1981 Nelson ..... 42/90

4,353,282 10/1982 Holt ..... 42/90

*Primary Examiner*—Charles T. Jordan

[57] ABSTRACT

A lubricator device for Maxi-ball bullets, including a cylinder and a plunger assembly slideable in one end of the cylinder, a seat in the other end of the cylinder for seating a Maxi-ball therein, while lubricant is discharged from a lubricant container spout into the seat; and the plunger assembly then pushing the lubricated Maxi-ball into a rifle muzzle and setting it at a proper distance therewithin for being fired.

2 Claims, 6 Drawing Figures

Fig. 1
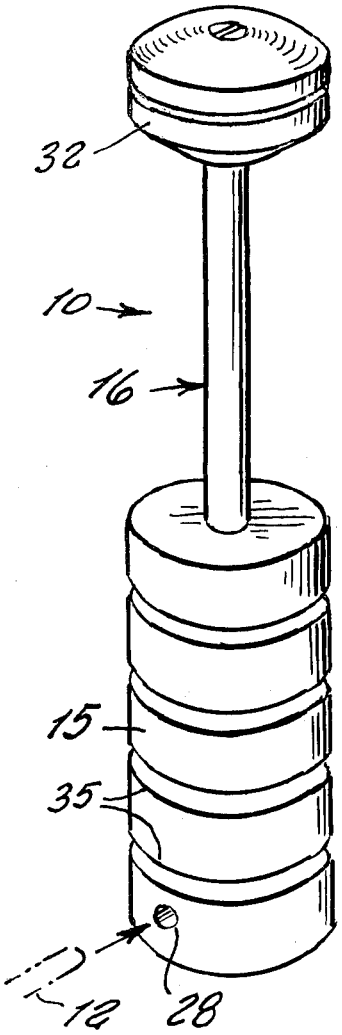
Fig. 2
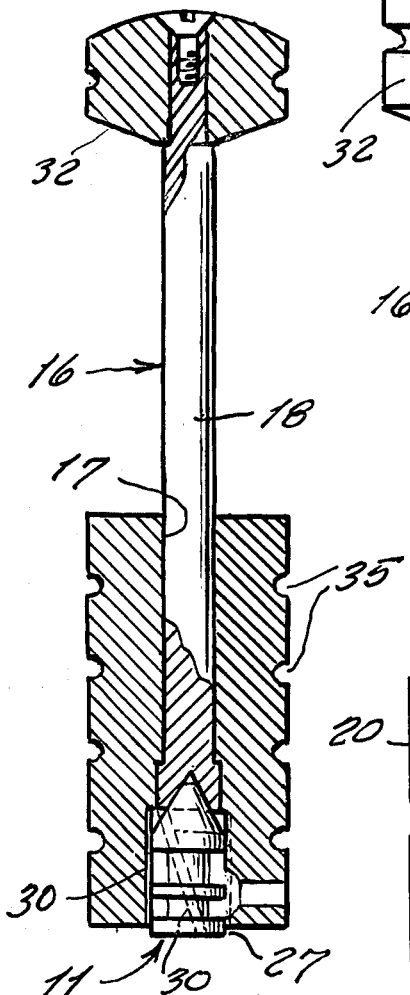
Fig. 4
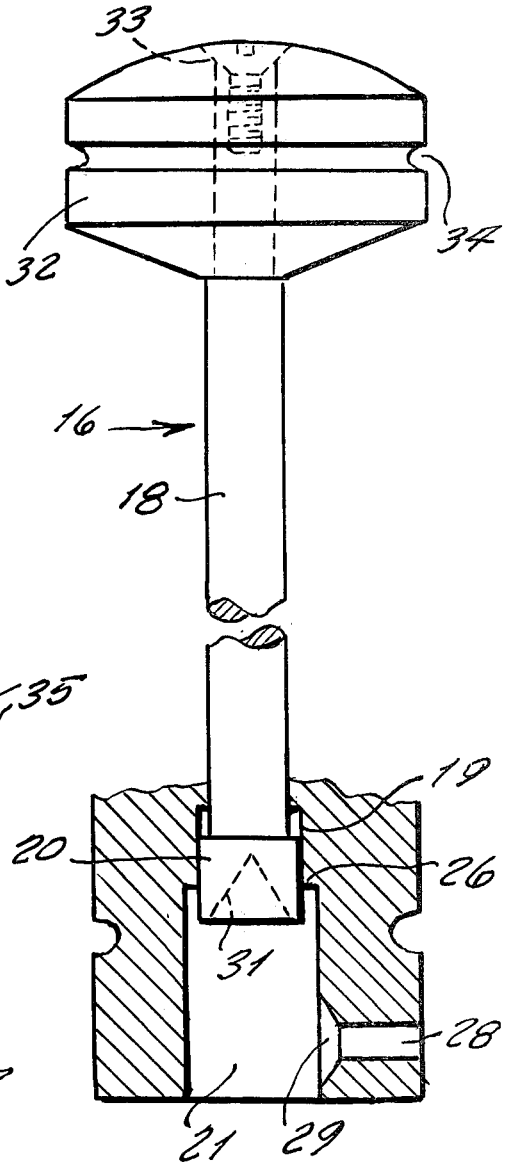
Fig. 3
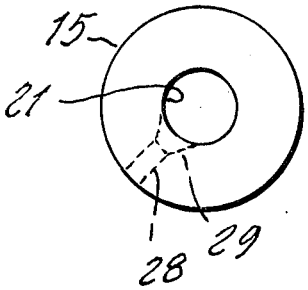
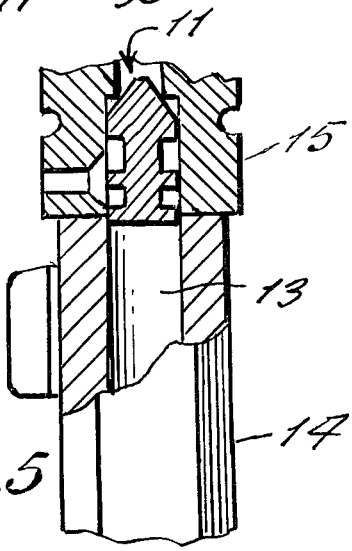
Fig. 5
Fig. 6
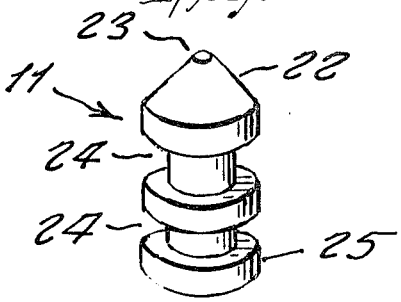

MAXI-BALL LUBRICATOR

This invention relates generally to firearms accessories. More specifically, it relates to bullet-lubricating devices.

It is well known that many firearm enthusiasts use Maxi-ball bullets for firing in muzzle-loading rifles, and these Maxi-balls are lubricated by them manually, by applying the lubricant directly thereto with the fingers. This can be a messy operation, and is therefore in need of an improvement.

Accordingly, it is a principal object of the present invention to provide a lubricator device, which lubricates Maxi-balls without this usual mess that was unavoidable heretofore, the lubricator performing the task more easily, faster and conveniently.

Another object is to provide a Maxi-ball lubricator, which thoroughly lubricates the entire side surface of the Maxi-ball, without missing any portion thereof.

Yet another object is to provide a Maxi-ball lubricator, which additionally starts the ball straight in the rifle barrel, thus allowing the user to avoid ever touching the lubricant or the lubricated ball.

Other objects of the present invention are to provide a Maxi-ball lubricator, which is simple in design, inexpensive to manufacture, rugged in construction, easy to use and efficient in operation.

These, and other objects, will be readily evident, upon a study of the following specification, and the accompanying drawing, wherein:

FIG. 1 is a perspective view of the Maxi-ball lubricator;

FIG. 2 is a side cross-sectional view thereof, taken on line 2—2 of FIG. 1, and showing a Maxi-ball loaded therein;

FIG. 3 is a bottom plan view thereof;

FIG. 4 is a fragmentary view similar to FIG. 2, shown enlarged, and without the Maxi-ball placed therewithin;

FIG. 5 is a fragmentary side cross-sectional view of the lubricator shown transferring the lubricated Maxi-ball into the muzzle of a rifle, and FIG. 6 is an enlarged perspective view of the Maxi-ball, shown per se.

Referring now to the drawing in greater detail, the reference numeral 10 represents a Maxi-ball lubricator, according to the present invention, wherein a Maxi-ball 11 is placed, and then lubricated directly from a spout 12 of a lubricant container, before being directly transferred therefrom into a muzzle 13 of a rifle 14.

The Maxi-ball lubricator 10 comprises a cylinder 15 and a plunger assembly 16 that is slideable therein. The cylinder includes a central opening 17, slideably receiving a push rod 18 of the plunger assembly; the opening 17 having at its one end a counterbore 19 for an enlarged head 20 on the end of the push rod, the counterbore communicating with a cylindrical seat 21, into which the Maxi-ball is placed. The seat is sized to receive either 36, 45, 50 or 54 caliber Thompson/Center or Lyman Maxi-balls.

As shown in FIG. 6, the Maxi-ball is generally cylindrical in shape, having a conical tapered portion 22 at one end toward a point 23, and also including a plurality of annular grooves 24 around its cylindrical side 25.

The seat 21 is diametrically larger than the counterbore 19, so as to form a shoulder 26 therebetween, and against which the Maxi-ball abuts its conically-shaped portion, so as to limit its distance of insertion into the cylinder, in order that a very small rear end portion 27 of the Maxi-ball protrudes outward of the lubricator, for being aligned with the rifle muzzle when being transferred thereto.

A transverse hole 28, in the cylinder, extends radially between the Maxi-ball seat and the outer surface of the cylinder, so as to permit insertion of the lubricant container spout 12 therein, the inward end 29 of hole 28 being widened as shown, so as to allow the lubricant to flow into both the annular grooves of the Maxi-ball. If preferred by a manufacturer, the side wall of the seat may additionally be grooved with spiral flutes 30 (as suggested in FIG. 2), so as to allow the lubricant to lubricate the side 25 of the Maxi-ball, as it is pushed axially straight out of the seat and into the rifle muzzle.

As shown, the push rod head includes a conical recess 31 in its end for receiving the conical point portion of the Maxi-ball.

The outer end of the push rod is fitted with a knob 32 secured thereto by a screw 33, the head including an annular groove 34 for better frictional grasp thereof. Similarly, annular grooves 35, around the cylinder, serve the same purpose.

In operative use, it is now evident that the Maxi-ball may thus be more conveniently lubricated without any mess, and inserted straight into the rifle muzzle by pushing the plunger assembly thereagainst, so as to eliminate any physical handling of the Maxi-ball; the plunger assembly setting the Maxi-ball at proper distance inside the muzzle, to be seated with ram rod to proper depth, for being fired.

While various changes may be made in the detail construction, it is understood that such changes will be within the spirit and scope of the present invention, as is defined by the appended claims.

What I claim as new is:

1. A maxi-ball lubricator, comprising, in combination, a cylinder and a plunger assembly slidable in said cylinder, a seat on one end of said cyylinder for a maxi-ball bullet to be seated therein, while a hole in a side of said cylinder receives a lubricant container spout for discharging a lubricant into said seat and against said maxi-ball, and said plunger assembly being aligned with said seat for pushing said maxi-ball outward of said seat and into a rifle muzzle; said plunger assembly comprising a push rod having an enlarged head at one end for pushing against an end of said maxi-ball, while an opposite end of said push rod is fitted with an enlarged knob for being grasped in a hand, and said push rod head having a conical recess in its end for receiving a conical point portion of said maxi-ball.

2. The combination as set forth in claim 1, wherein a side wall of said seat includes means so as to allow said lubricant to lubricate a side wall of said maxi-ball, as said maxi-ball is pushed axially straight outward of said seat and into said rifle muzzle.

* * * * *